US008783848B2

(12) United States Patent
Yokozawa

(10) Patent No.: US 8,783,848 B2
(45) Date of Patent: Jul. 22, 2014

(54) MARKING DEVICE, MANUFACTURING DEVICE, AND MARKING METHOD

(75) Inventor: Toshihiro Yokozawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 224 days.

(21) Appl. No.: 13/416,445

(22) Filed: Mar. 9, 2012

(65) Prior Publication Data

US 2012/0236097 A1 Sep. 20, 2012

(30) Foreign Application Priority Data

Mar. 18, 2011 (JP) ..... 2011-061049

(51) Int. Cl.
*B41J 2/01* (2006.01)
*B41J 11/00* (2006.01)

(52) U.S. Cl.
CPC ..... *B41J 11/0015* (2013.01); *B41J 11/007* (2013.01)
USPC ..... 347/102; 347/104

(58) Field of Classification Search
CPC ..... B41J 2/01; B41J 2/2114; B41J 3/01; B41J 3/4078; B41J 11/06; B41J 11/002; B41J 11/007; B41J 11/009; B41J 11/0015; B41J 11/0065; B41J 11/0085; B41J 13/103; B41J 2202/09; B41M 5/52; B41M 7/00; B41M 7/0072; C09D 11/101; D06P 5/30; G02B 5/201; G02F 1/133516
USPC ..... 347/101, 102, 104, 106, 107
See application file for complete search history.

(56) References Cited

U.S. PATENT DOCUMENTS

| | | | | |
|---|---|---|---|---|
| 2005/0190225 | A1* | 9/2005 | Sakamoto | 347/22 |
| 2007/0002115 | A1* | 1/2007 | Nakazawa | 347/102 |
| 2007/0247508 | A1* | 10/2007 | Miura | 347/102 |
| 2010/0128097 | A1* | 5/2010 | Sootome | 347/104 |

FOREIGN PATENT DOCUMENTS

| | | | |
|---|---|---|---|
| JP | 07-073991 | A | 3/1995 |
| JP | 07-263172 | A | 10/1995 |
| JP | 11-040653 | A | 2/1999 |
| JP | 2003-080687 | A | 3/2003 |
| JP | 2003-282673 | A | 10/2003 |
| JP | 2007-152438 | A | 6/2007 |
| JP | 2007-280914 | A | 10/2007 |

* cited by examiner

*Primary Examiner* — Manish S Shah
*Assistant Examiner* — Roger W Pisha, II
(74) *Attorney, Agent, or Firm* — Global IP Counselors, LLP

(57) ABSTRACT

A marking device includes a plurality of treatment devices, a transporting part, a static eliminator and a controller. Each of the treatment devices is configured and arranged to perform a treatment on a base material. The transporting part is configured and arranged to transport the base material between the treatment devices. The static eliminator is disposed near a path along which the base material is transported by the transporting part. The controller is configured to control the transporting part to follow a transport path routed via the static eliminator when the base material is transported to the treatment devices.

9 Claims, 9 Drawing Sheets

MARKING DEVICE, MANUFACTURING DEVICE, AND MARKING METHOD

CROSS-REFERENCE TO RELATED APPLICATIONS

This application claims priority to Japanese Patent Application No. 2011-061049 filed on Mar. 18, 2011. The entire disclosure of Japanese Patent Application No. 2011-061049 is hereby incorporated herein by reference.

BACKGROUND

1. Technical Field

The present invention relates to a marking device, a manufacturing device, and a marking method.

2. Related Art

In recent years, attention has been directed on liquid droplet ejection devices for forming an image or a pattern on a recording medium using a UV-curable ink that is cured by UV ray irradiation. UV-curable ink has characteristics that are preferable for printing ink, where curing is extremely slow until irradiated with UV rays, whereas curing occurs rapidly when irradiated with UV light. UV-curable ink also has a benefit in that no solvent is vaporized during curing, resulting in a smaller environmental load.

UV-curable ink also adheres readily to a variety of recording media, depending on vehicle composition. After curing, UV-curable ink is also chemically stable; has high adhesive performance, resistance to chemicals, weathering resistance, friction resistance, and the like; is resistant to outdoor environments; and has other excellent characteristics. Therefore, it is possible to form images on surfaces of recording medium labels, textiles, and other surfaces having some degree of a three-dimensional surface shape, in addition to paper, resin films, metal foils, or other thin sheet-shaped recording media.

There are disclosed techniques for printing product serial numbers, manufacturer identification, or other attributes on an IC on a substrate using the above-mentioned UV-curable ink through a liquid droplet ejection method (e.g., Japanese Laid-Open Patent Application Publication No. 2003-080687). When a printing treatment is performed on the above-mentioned substrate, the substrate is transported to a liquid droplet ejection device, a pretreatment device, and other treatment devices relating to printing; and treatment is performed with the substrate being retained using, e.g., a suction pad. However, in an instance in which a suction pad is used, there is a possibility of an electrostatic buildup occurring when the substrate is separated from the pad, and of an electric current flowing and destroying the IC when the substrate is provided to an electrically conductive table. Therefore, Japanese Laid-Open Patent Application Publication No. 2007-152438 discloses a technique in which an ionizer (a static eliminator) is provided to each of the treatment parts. Japanese Laid-Open Patent Application Publication No. 2007-280914 discloses a technique in which a static eliminator is provided to a transporting device for transporting the substrate.

SUMMARY

However, conventional techniques such as those described above present the following problems.

According to the technique described in Japanese Laid-Open Patent Application Publication No. 2007-152438, a large number of static eliminators become necessary, leading to an increase in the cost and size of the device. According to the technique described in Japanese Laid-Open Patent Application Publication No. 2007-280914, there is a need to increase the stiffness of the transporting device so that the static eliminator can be supported in a stable manner, and, in relation to transport paths of the transportation device, a need to ensure all transport paths have adequate space through which the static eliminator can move; and an increase in the size of the device is inevitable.

With the above-mentioned circumstances in view, an object of the present invention is to provide a printing device and a manufacturing device that can contribute towards reducing device size and transporting a base material in a stable manner.

A following configuration is used in order to achieve the above-mentioned object.

A marking device according to one aspect of the present invention includes a plurality of treatment devices, a transporting part, a static eliminator and a controller. Each of the treatment devices is configured and arranged to perform a treatment on a base material. The transporting part is configured and arranged to transport the base material between the treatment devices. The static eliminator is disposed near a path along which the base material is transported by the transporting part. The controller is configured to control the transporting part to follow a transport path routed via the static eliminator when the base material is transported to the treatment devices.

Therefore, in the marking device of the above described aspect of the present invention, the base material is routed via the static eliminator when being transported; therefore, it is possible to transport the base material to a destination treatment device in a stable manner in a state in which peeling electrification has been eliminated. The static eliminator according to the present invention is not provided to the individual transporting parts but is provided on a path along with the base material is transported; therefore, there is no need to provide along the entire transport path a space through which the static eliminator can move, and it is possible to avoid making the device larger or more expensive.

As used herein, the phrase "routed via the static eliminator" includes performing a control so that the transporting part passes through a position facing the static eliminator, or performing a control so that the transporting part comes into direct contact with the static eliminator. If the static eliminator generates ions or other static-eliminating substances, a control may be performed so that the transporting part passes through a space in which the static-eliminating substance is present.

A scalar-type robot can be suitably used for the transporting part.

For the controller, a configuration can be suitably used in which the speed at which the base material is transported at the static eliminator is reduced so as to be lower than the speed at which the base material is transported to the static eliminator.

It is thereby possible in the present invention to perform the static elimination process on the base material in a stable and reliable manner.

In another aspect of the present invention, a configuration can be suitably used in which a static elimination treatment is performed at the static eliminator on a side of a surface at which the base material is retained by the treatment devices.

It is thereby possible in the above described aspect of the present invention to perform static elimination in an efficient manner on a surface of the base material where buildup of static electricity readily occurs.

For the transporting part, a configuration can be suitably used in which the transporting part comprises a gripping part configured and arranged to grip, in a cantilevered fashion, an end edge of the base material.

It is thereby possible in the above described aspect of the present invention to perform static elimination in a substantially complete and effective manner with the exception of the end edge of the base material.

In the present invention, a configuration can be suitably used in which the treatment devices include an application device configured and arranged to apply the liquid droplets on a semiconductor device provided to a surface of the base material.

It is thereby possible in the above described aspect of the present invention to coat/print, at a predetermined printing quality and in an inexpensive manner, a print pattern indicating attribute information or other information regarding the semiconductor device onto a base material transported in a stable manner without the semiconductor device being damaged.

In the above-mentioned configuration, a configuration can be suitably used in which the application device is configured and arranged to eject, onto a base material that has been transported by the transporting part, liquid droplets of a liquid that is cured by active light.

Therefore, in the marking device of the above described aspect of the present invention, it is possible to eliminate any adverse effect caused by buildup of static electricity and perform a marking treatment in a stable manner while reducing the size and the cost of the device.

A manufacturing device according to another aspect of the present invention includes a plurality of treatment devices, a transporting part configured and arranged to transport a base material between the treatment devices, a static eliminator disposed near a path along which the base material is transported by the transporting part, and a controller configured to control the transporting part to follow a transporting part routed via the static eliminator when the base material is transported to the treatment devices.

A configuration can be suitably used in which the transporting part includes a scalar-type robot.

A marking method according to another aspect of the present invention includes: providing a plurality of treatment devices, each of which devices is configured and arranged to perform a treatment on a base material; transporting the base material between the treatment devices; and providing a static eliminator near a path along which the base material is transported. The transporting of the base material includes transporting the base material so that the base material follows a transporting path routed via the static eliminator when the base material is transported to the treatment devices.

Directions of relative movement and directions that are orthogonal described in the present specifications include ranges of deviation caused by, e.g., error originating from manufacture/assembly.

BRIEF DESCRIPTION OF THE DRAWINGS

Referring now to the attached drawings which form a part of this original disclosure.

DETAILED DESCRIPTION OF EXEMPLARY EMBODIMENTS

Figure 1A:
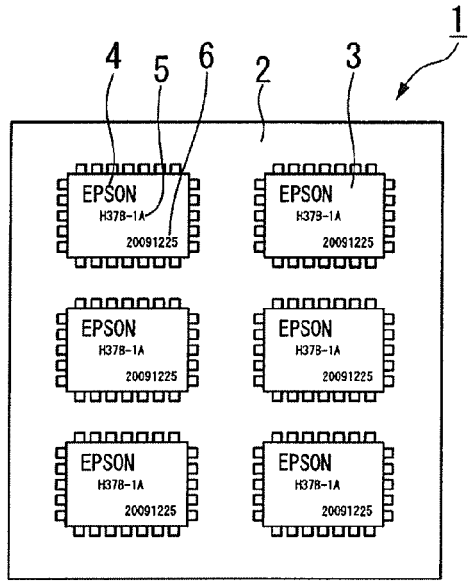
FIG. 1A is a schematic top view showing a semiconductor substrate.

An embodiment of a printing device and a manufacturing device according to the present invention will now be described with reference to FIGS. 1 through 11.

The following embodiment shows one mode of the present invention. This mode is not intended to limit the scope of the present invention, and can be modified as desired within the scope of technical ideas of the present invention. In the drawings described below, the scale, number, and other attributes of each structure are displayed differently from those of an actual structure so as to facilitate understanding of each of the structures.

Semiconductor Substrate

First, a description will be given for a semiconductor substrate, which is an example of a subject upon which drawing (printing) is to be performed using a printing device.

FIG. 1A is a schematic top view showing a semiconductor substrate. As shown in FIG. 1A, a semiconductor substrate 1 functioning as a base material comprises a substrate 2. The substrate 2 must have heat resistance and must be capable of having a semiconductor device 3 installed thereon. A glass epoxy substrate, a paper phenolic substrate, a paper epoxy substrate, or a similar substrate may be used for the substrate 2.

The semiconductor device 3 is installed on the substrate 2. A corporate identifying mark 4, a model code 5, a product serial number 6, and other marks (print patterns, predetermined patterns) are drawn on the semiconductor device 3. The marks are drawn using the printing device described further below.

Printing Device

Figure 1B:
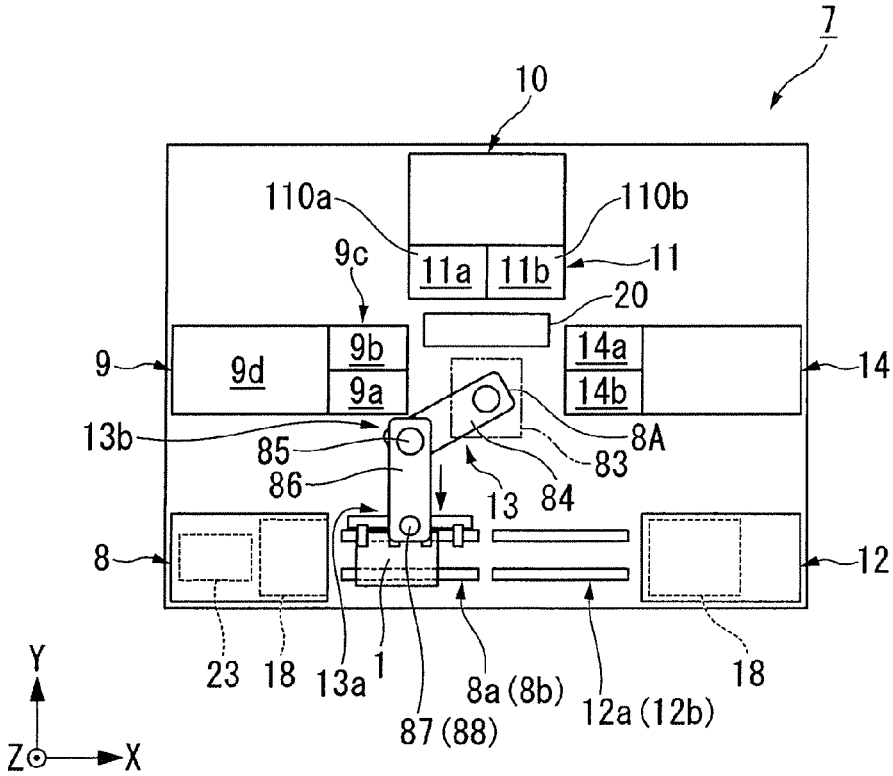
FIG. 1B is a schematic top view showing a liquid droplet ejection device.

FIG. 1B is a schematic top view showing the printing device.

Figure 10:
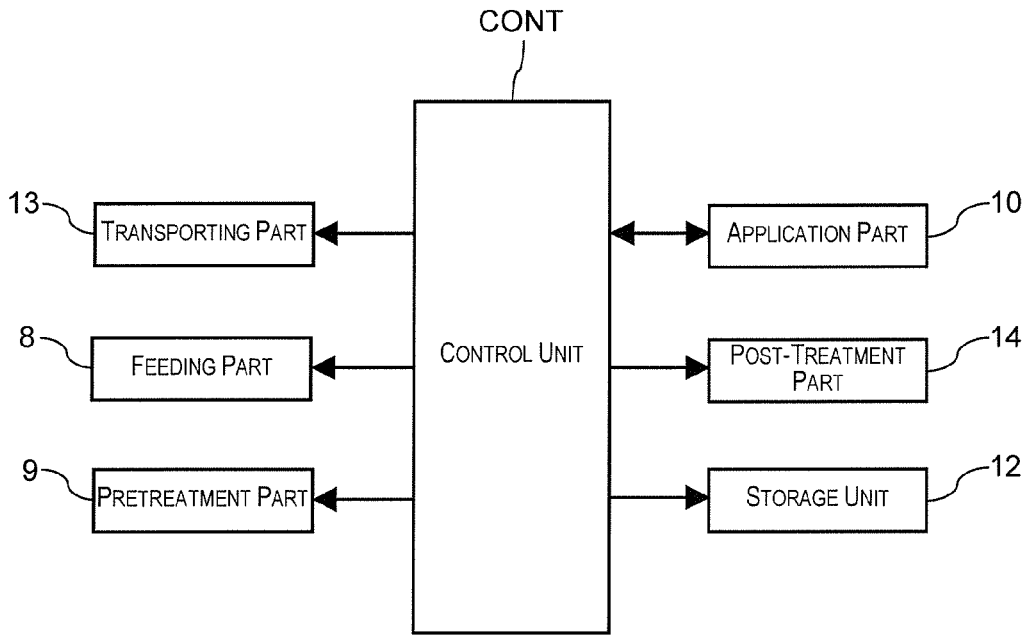
FIG. 10 is a block diagram showing a control system.

As shown in FIG. 1B, the printing device 7 is configured from a plurality of treatment devices for performing a variety of treatments related to printing, principally including a feeding part 8, a pretreatment part 9, an application part (printing part) 10, a cooling part 11, a storage part 12, a transporting part 13, a post-treatment part 14, a static eliminator 20, and a controller CONT (see FIG. 10). A direction along which the feeding part 8 and the storage part 12 are arranged, and a direction along which the pretreatment part 9, the cooling part 11, and the post-treatment part 14 are arranged are referred to as the x-direction. A direction orthogonal to the x-direction is referred to as the y-direction. The application part 10, the cooling part 11, and the transporting part 13 are positioned so as to be arranged along the y-direction. A perpendicular direction is referred to as the z-direction.

The feeding part 8 comprises a storage container in which a plurality of semiconductor substrates 1 are stored. The feeding part 8 also comprises a relay location 8*a*, and feeds the semiconductor substrate 1 from the storage container to the relay location 8*a*. A pair of rails 8*b* extending in the x-direction are provided to the relay location 8*a* at a substantially identical height relative to that of a semiconductor substrate 1 conveyed from the storage container.

The pretreatment part 9 has a function of reforming, while heating, a surface of the semiconductor device 3. The pretreatment part 9 adjusts the magnitude of spreading of ejected liquid droplets, and the adhesive performance of the mark to be printed, in relation to the semiconductor device 3. The pretreatment part 9 comprises a first relay location 9*a* and a second relay location 9*b*. The pretreatment part 9 takes an untreated semiconductor substrate 1 from the first relay location 9*a* or the second relay location 9*b* and performs surface reforming. Then, the pretreatment part 9 moves the treated semiconductor substrate 1 to the first relay location 9*a* or the second relay location 9*b*, and places the semiconductor substrate 1 in standby status. The first relay location 9*a* and the second relay location 9*b* are collectively referred to as a relay location 9*c*. A location within the pretreatment part 9 at which pretreatment is performed is referred to as a treatment location 9*d*.

The cooling part 11 is positioned in a relay location for the application part 10, and has a function of cooling the semiconductor substrate 1 on which heating and surface reforming has been performed in the pretreatment part 9. The cooling part 11 has treatment locations 11*a*, 11*b*, each of which being used for retaining and cooling a semiconductor substrate 1. The treatment locations 11*a*, 11*b* may be collectively referred to as a treatment location 11*c* as appropriate.

The application part 10 has a function of ejecting liquid droplets onto the semiconductor device 3 and drawing (printing) a mark; and of causing the drawn mark to solidify or cure. The application part 10 moves a pre-drawn semiconductor substrate 1 from the cooling part 11, which functions as a relay location, and performs a drawing treatment and a curing treatment. Then, the application part 10 moves the drawn semiconductor substrate 1 to the cooling part 11 and places the semiconductor substrate 1 in standby status.

The post-treatment part 14 performs a reheating treatment, as a post-treatment, on the semiconductor substrate 1 placed in the cooling part 11 after the drawing treatment has been performed in the application part 10. The post-treatment part 14 comprises a first relay location 14*a* and a second relay location 14*b*. The first relay location 14*a* and the second relay location 14*b* are collectively referred to as a relay location 14*c*.

The storage part 12 comprises a storage container capable of storing a plurality of semiconductor substrates 1. The storage part 12 comprises a relay location 12*a*, and the semiconductor substrate 1 is moved from the relay location 12*a* so as to be stored into the storage container. A pair of rails 12*b* extending in the x-direction are provided to the relay location 12*a* at a height substantially identical to that of the storage container for storing the semiconductor substrates 1. The operator transports the storage container, in which the semiconductor substrates 1 are stored, from the printing device 7.

The transporting part 13 is positioned at a location at a center of the printing device 7. A scalar-type robot comprising an arm part 13*b* is used for the transporting part 13. A gripping part 13*a* for gripping, in a cantilevered fashion, a side edge of the semiconductor substrate 1 while supporting the semiconductor substrate 1 from a reverse surface (lower surface), is provided to a distal end of the arm part 13*b*. The relay locations 8*a*, 9*c*, 11, 14*c*, and 12*a* are positioned within a range of movement of the gripping part 13*a*. Therefore, the gripping part 13*a* is capable of moving the semiconductor substrate 1 between the relay locations 8*a*, 9*c*, 11, 14*c*, and 12*a*.

The static eliminator 20 is used for performing a static elimination treatment (static electricity removal treatment) on the semiconductor substrate 1 transported by the transporting part 13. The static eliminator 20 is configured from an ionizer, a soft X-ray emitter, or a similar device; and is provided at a position surrounded by the pretreatment part 9, the cooling part 11, the post-treatment part 14, the feeding part 8, and the storage part 12 as shown in FIG. 1B (details will be described further below).

The controller CONT is a device for controlling the operation of the entire printing device 7, and manages the state of operation of each of the parts of the printing device 7. The controller CONT outputs a signal commanding the transporting part 13 to move the semiconductor substrate 1. The semiconductor substrate 1 is thereby moved in sequence through each of the parts and subjected to drawing.

Details of each of the parts will now be described.

Feeding Part

Figure 2A:
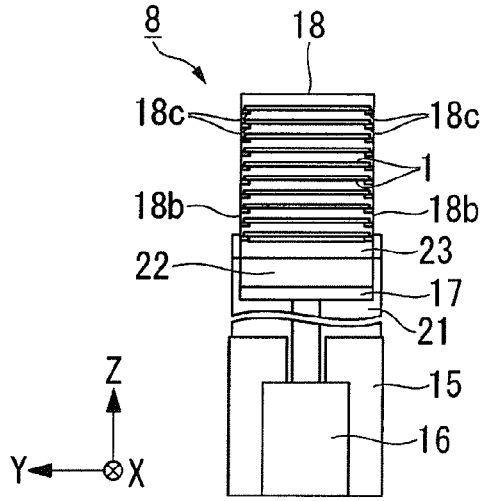
FIGS. 2A to 2C are schematic views showing a feeding part.
Figure 2B:
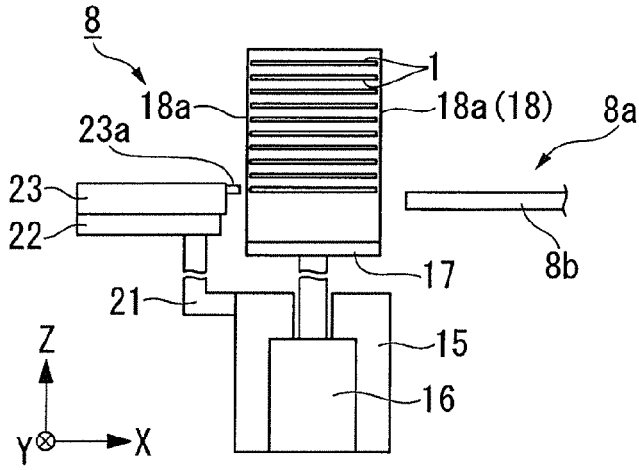
Figure 2C:
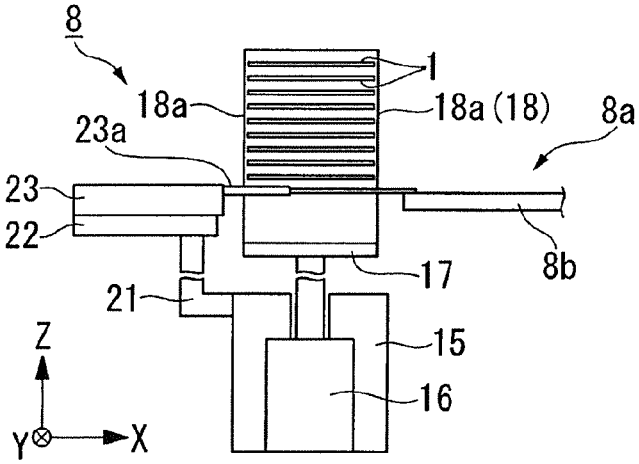

FIG. 2A is a schematic front view showing the feeding part, and FIGS. 2B and 2C are schematic side views showing the feeding part. As shown in FIGS. 2A and 2B, the feeding part 8 comprises a base 15. A lift device 16 is installed inside the base 15. The lift device 16 comprises a linear motion mechanism that operates in the z-direction. A combination of a ball screw and a rotary motor, a combination of a hydraulic cylinder and an oil pump, or a similar mechanism can be used for the linear motion mechanism. In the present embodiment, e.g., a mechanism comprising a ball screw and a step motor is used. A lift plate 17 is installed, in connection with the lift device 16, to an upper side of the base 15. The lift plate 17 is capable of being moved up and down by the lift device 16 by a predetermined amount of movement.

A storage container 18 having a cuboid shape is installed on the lift plate 17, and a plurality of semiconductor substrates 1 are stored in the storage container 18. An opening part 18*a* is formed on both surfaces in the x-direction, and the semiconductor substrate 1 can be inserted or removed through the opening part 18*a*. Convex-shaped rails 18*c* are formed on an inside of a side surface 18*b* positioned at both sides of the storage container 18 in the y-direction. The rails 18*c* are positioned so as to extend in the x-direction. The rails 18*c* are plurally arranged in a row at regular intervals along the z-direction. The semiconductor substrates 1 are inserted along the rails 18*c* from the x-direction or the −x-direction, whereby the semiconductor substrates 1 are stored so as to be arranged in a row along the z-direction.

A pushing device 23 is installed on an x-direction side of the base 15 with a support member 21 and a support platform 22 interposed therebetween. A pushing pin 23*a*, which is projected in the x-direction by a linear motion mechanism similar to the lift device 16, and which is used for pushing the semiconductor substrate 1 out towards the rails 8*b*, is provided to the pushing device 23. Therefore, the pushing pin 23*a* is provided at a height substantially identical to that of the rails 8*b*.

As shown in FIG. 2C, the pushing pin 23*a* of the pushing device 23 projects towards the +x side, whereby a semiconductor substrate 1 positioned at a height slightly further towards the +z side than the rail 18*c* is pushed out from the storage container 18, moved onto the rail 8*b*, and supported.

When the semiconductor substrate 1 has moved onto the rail 8*b*, the pushing pin 23*a* returns to a standby position shown in FIG. 2B. Next, the lift device 16 lowers the storage container 18 and moves a next semiconductor substrate 1 to be treated to a height opposite the pushing pin 23*a*. Subsequently, in a similar manner to that described above, the pushing pin 23*a* is caused to project, and the semiconductor substrate 1 is moved onto the rails 8*b*.

Thus, the feeding part 8 sequentially moves the semiconductor substrate 1 from the storage container 18 onto the rails 8*b*. When all of the semiconductor substrates 1 in the storage container 18 have been moved onto the rails 8*b*, the operator replaces the empty storage container 18 with a storage container 18 in which semiconductor substrates 1 are stored. It is thereby possible to feed the semiconductor substrate 1 to the feeding part 8.

Pretreatment Part

The pretreatment part 9 performs, at the treatment location 9*d*, pretreatment on the semiconductor substrate 1 transported to the relay locations 9*a*, 9*b*. Examples of pretreatment include active light irradiation using, e.g., a low pressure mercury lamp, a hydrogen burner, an excimer laser, a plasma discharge part, a corona discharge part, or a similar device, in a heated state. In an instance in which a mercury lamp is used, the semiconductor substrate 1 is irradiated with UV rays, whereby the liquid repellency of a surface of the semiconductor substrate 1 can be reformed. In an instance in which a hydrogen burner is used, an oxidized surface of the semiconductor substrate 1 can be partially reduced to roughen the surface. In an instance in which an excimer laser is used, the surface of the semiconductor substrate 1 can be subjected to melt solidification and thereby roughened. In an instance in which plasma discharge or corona discharge is used, the surface of the semiconductor substrate 1 can be mechanically scraped and thereby roughened. In the present embodiment, e.g., a mercury lamp is used.

When the pretreatment has ended, the pretreatment part 9 moves the semiconductor substrate 1 to the relay location 9*c*. Next, the transporting part 13 removes the semiconductor substrate 1 from the relay location 9*c*.

Cooling Part

The cooling part 11 has heat sinks or other cooling plates 110*a*, 110*b*, respectively provided to each of the treatment locations 11*a*, 11*b*. An upper surface of each of the cooling plates 110*a*, 110*b* is a surface against which the semiconductor substrate 1 is suctioned and retained.

The treatment locations 11*a*, 11*b* (the cooling plates 110*a*, 110*b*) are positioned within the range of operation of the gripping part 13*a*. In the treatment locations 11*a*, 11*b*, the cooling plates 110*a*, 110*b* are exposed. Therefore, the transporting part 13 can readily place the semiconductor substrate 1 on the cooling plates 110*a*, 110*b*. After the cooling treatment has been performed on the semiconductor substrate 1, the semiconductor substrate 1 is placed in standby status on the cooling plate 110*a* positioned at the treatment location 11*a* or the cooling plate 110*b* positioned at the treatment location 11*b*. Therefore, the gripping part 13*a* of the transporting part 13 can readily grip and move the semiconductor substrate 1.

Application Part

Next, a description will be given for the application part 10 for ejecting liquid droplets onto the semiconductor substrate 1 and forming a mark, with reference to FIGS. 3 through 6. A variety of types of devices exist with regards to a device for ejecting the liquid droplets; however, a device in which the inkjet method is used is preferred. The inkjet method allows ejection of minute liquid droplets, and is therefore suitable for fine processing.

Figure 3A:
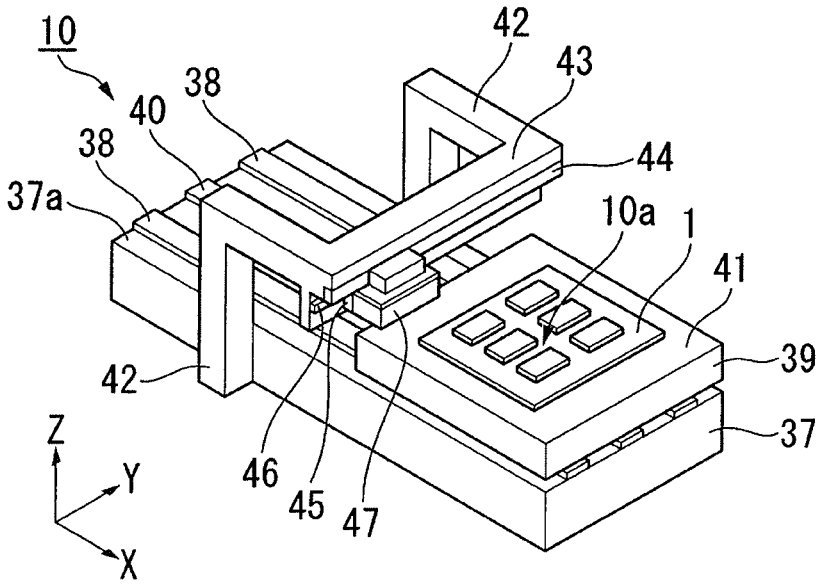
FIG. 3A is a schematic perspective view showing a configuration of an application part.

FIG. 3A is a schematic perspective view showing a configuration of the application part. Liquid droplets are ejected onto the semiconductor substrate 1 by the application part 10. As shown in FIG. 3A, the application part 10 comprises a base 37 formed to a cuboid shape. A direction along which liquid droplet ejection heads and an object onto which the liquid droplets are ejected move relative to each other during liquid droplet ejection is referred to as a horizontal scan direction. A direction orthogonal to the horizontal scan direction is referred to as a vertical scan direction. The vertical scan direction is a direction along which the liquid droplet ejection heads and the object onto which the liquid droplets are ejected move relative to each other during a line feed. In the present embodiment, the y-direction (the second direction) is the horizontal scan direction, and the x-direction (the first direction) is the vertical scan direction.

A pair of guide rails 38 extending in the x-direction are protrudingly provided along the full width of an upper surface 37*a* of the base 37 in the x-direction. A stage 39 comprising a linear motion mechanism (not shown) corresponding to the guide rails 38 is attached on an upper side of the base 37. A linear motor, a screw-type linear motion mechanism, or a similar mechanism can be used for the linear motion mechanism of the stage 39. In the present embodiment, e.g., a linear motor is used. The stage 39 is configured so as perform a forward movement or a reverse movement along the x-direction at a predetermined speed. The forward movement and the reverse movement being repeatedly performed is referred to as a scan movement. A vertical scan position detection device 40 is positioned on the upper surface 37*a* of the base 37 so as to be parallel to the guide rails 38. The vertical scan position detection device 40 detects the position of the stage 39.

A placing surface 41 is formed on an upper surface of the stage 39. A suction-type substrate chuck mechanism (not shown) is provided to the placing surface 41. After the semiconductor substrate 1 has been placed on the placing surface 41, the semiconductor substrate 1 is secured to the placing surface 41 by the substrate chuck mechanism.

The location of the placing surface 41 when the stage 39 is, e.g., positioned on the +x side is a relay location corresponding to a position at which the semiconductor substrate 1 is loaded or unloaded. The placing surface 41 is installed so as to be exposed within the range of operation of the gripping part 13*a*. Therefore, the transporting part 13 can readily place the semiconductor substrate 1 onto the placing surface 41. After a mark has been applied (drawn) on the semiconductor substrate 1, the semiconductor substrate 1 is placed in standby status on the placing surface 41, which is the relay location. Therefore, the gripping part 13*a* of the transporting part 13 can readily grip and move the semiconductor substrate 1.

A pair of support platforms 42 are provided upright on both sides of the base 37 in the y-direction, and a guide member 43 extending in the y-direction is provided between the support platforms 42. A guide rail 44 extending in the y-direction is protrudingly provided along the full width of a lower side of the guide member 43 in the y-direction. A carriage (movement means) 45 attached so as to be capable of moving along the guide rail 44 is formed so as to have a substantially cuboid shape. The carriage 45 comprises a linear motion mechanism, and a similar mechanism as that used in, e.g., the linear motion mechanism provided to the stage 39 can be used for this linear motion mechanism. The carriage 45 performs a scan movement along the y-direction. A horizontal scan position detection device 46 is positioned between the guide member 43 and the carriage 45, and the position of the carriage 45 is measured. A head unit 47 is installed on a lower side of the carriage 45, and liquid droplet ejection heads (not shown) are protrudingly provided on a surface of the head unit 47 on a side nearer the stage 39.

Figure 3B:
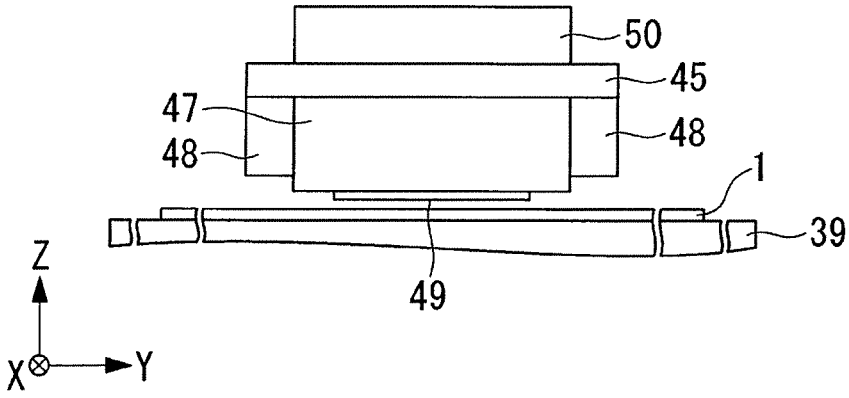
FIG. 3B is a schematic side view showing a carriage.

FIG. 3B is a schematic side view showing the carriage. As shown in FIG. 3B, a pair of curing units 48 functioning as emission parts, and a head unit 47, are located, on a side of the carriage 45 nearer the semiconductor substrate 1, at an equal respective distance from a center of the carriage 45 in the y-direction. Liquid droplet ejection heads (ejection heads) 49 for ejecting liquid droplets are protrudingly provided on a side of the head unit 47 nearer the semiconductor substrate 1.

An accommodating tank 50 is positioned on an upper side, in relation to the drawing, of the carriage 45; and a functional fluid is accommodated in the accommodating tank 50. The liquid droplet ejection head 49 and the accommodating tank 50 are connected by a tube (not shown), and the functional fluid in the accommodating tank 50 is fed to the liquid droplet ejection heads 49 via the tube.

The functional fluid has a resin material, a photopolymerization initiator functioning as a curing agent, and a solvent or a dispersion medium as main ingredients. A pigment, a dye, or another colorant; a lyophilic, a liquid repellent, or another surface reforming material; and other functional materials can be added to the main ingredients to form a functional fluid having an inherent function. In the present embodiment, e.g., a white pigment is added. The resin material of the functional fluid is a material for forming a resin film. No specific limitations exist for the resin material as long as it is in liquid form at room temperature and forms a polymer through polymerization. A resin material having low viscosity is preferred, and one having a configuration of an oligomer is preferred. One having a configuration of a monomer is further preferred. The photopolymerization initiator is an additive that acts on a crosslinkable group of a polymer and causes a crosslinking reaction to proceed. For example, a benzyl dimethyl ketal or a similar substance can be used as the photopolymerization initiator. The solvent or the dispersion medium is used to adjust the viscosity of the resin material. The functional fluid is caused to have a viscosity at which ejection from the liquid droplet ejection heads can be readily performed, making it possible for the liquid droplet ejection heads to eject the functional fluid in a stable manner.

Figure 4A:
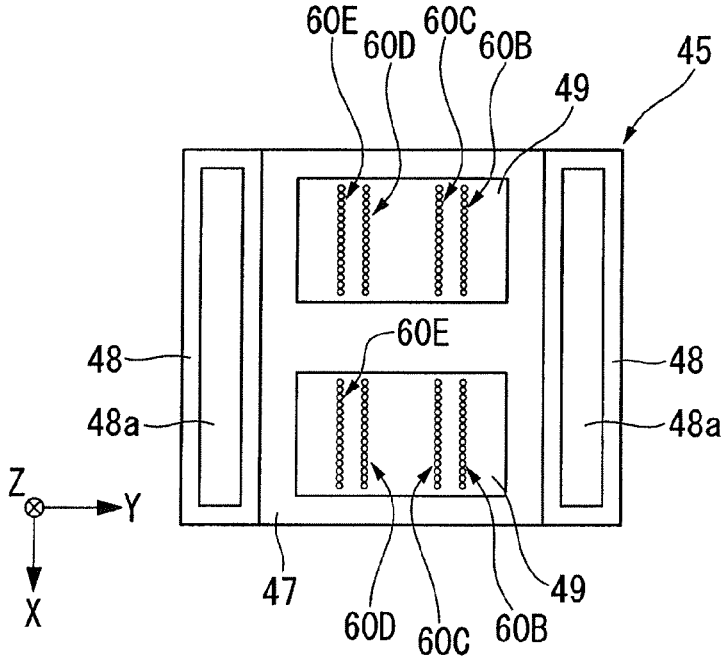
FIG. 4A is a schematic top view showing a head unit.
Figure 4B:
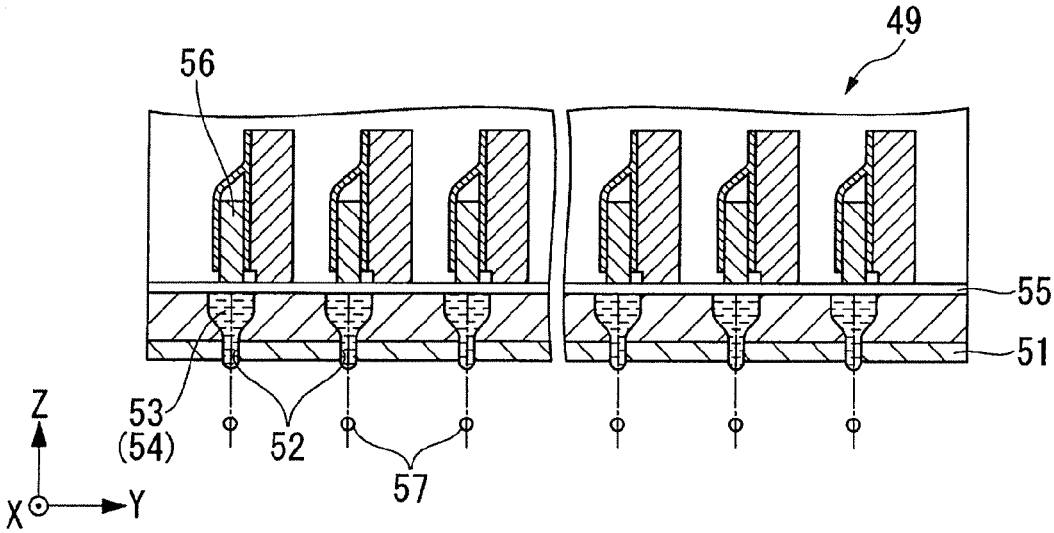
FIG. 4B is a schematic cross-section view of a main part of a liquid droplet ejection head, used to illustrate the structure.

FIG. 4A is a schematic top view showing a head unit. As shown in FIG. 4A, two liquid droplet ejection heads 49 are positioned, on the head unit 47, so that a gap is present between each other in the vertical scan direction (x-direction). A nozzle plate 51 (see FIG. 4B is positioned on a surface of each of the liquid droplet ejection heads 49. A plurality of nozzles 52 are formed so as to be arranged in a row on each of the nozzle plates 51. In the present embodiment, nozzle rows 60B through 60E, in which 15 nozzles 52 are positioned along the vertical scan direction, are positioned at intervals in the y-direction on each of the nozzle plates 51. Each of the nozzle rows 60B through 60E on the two liquid droplet ejection heads 49 are positioned in a straight line along the x-direction. Nozzle rows 60B and 60E are positioned at an equal distance from the center of the carriage 45 in the y-direction. Similarly, nozzle rows 60C and 60D are positioned at an equal distance from the center of the carriage 45 in the y-direction. Therefore, the distance between the curing unit 48 and the nozzle row 60B on the +y side, and the distance between the curing unit 48 and the nozzle row 60E on the −y side, are equal. The distance between the curing unit 48 and the nozzle row 60C on the +y side, and the distance between the curing unit 48 and the nozzle row 60D on the −y side, are also equal.

FIG. 4B is a schematic cross-section view of a main part of the liquid droplet ejection head, used to illustrate the structure. As shown in FIG. 4B, each of the liquid droplet ejection heads 49 comprises a nozzle plate 51, and the nozzles 52 are formed on the nozzle plate 51. Cavities 53 are formed at positions, on an upper side of the nozzle plate 51, that correspond to the nozzles 52. Each of the cavities 53 communicate to a nozzle 52. The functional fluid (liquid) 54 is fed to the cavities 53 of the liquid droplet ejection heads 49.

A vibration plate 55 for vibrating in the vertical direction and causing the volume within the cavities 53 to increase or decrease is installed above the cavities 53. Piezoelectric elements 56 that expand or contract in the vertical direction and cause the vibration plate 55 to vibrate are fixedly provided at locations above the vibration plate 55 that face the cavities 53. The piezoelectric elements 56 expand or contact in the vertical direction, apply pressure on the vibration plate 55, and vibrate; and the vibration plate 55 increases or decreases the volume within the cavities 53, and applies pressure to the cavities 53. The pressure within the cavities 53 thereby fluctuates, and the functional fluid 54 fed into the cavities 53 is ejected through the nozzles 52.

As shown in FIGS. 3B and 4A, the curing units 48 are positioned flanking the head unit 47 on two sides in relation to the horizontal scan direction (direction of relative movement). An emission device for emitting UV rays for curing the ejected liquid droplets is positioned in each of the curing units 48. The emission device is configured from a light-emitting part, a radiator plate, and other components. Multiple light-emitting diode (LED) elements are installed in a row in the light-emitting part. The LED elements are elements that are fed electrical power and emit UV light, which is light in UV rays. An emission opening 48*a* is formed on a lower surface of each of the curing units 48. UV light generated by the emission device is emitted from the emission opening 48*a* towards the semiconductor substrate 1.

When the liquid droplet ejection heads 49 receive a nozzle-driving signal for controlling and driving the piezoelectric elements 56, the piezoelectric elements 56 expand, and the vibration plates 55 reduce the volume in the cavities 53. As a result, the functional fluid 54 corresponding to the reduction in volume is ejected, as liquid droplets 57, from the nozzles 52 of the liquid droplet ejection heads 49. The semiconductor substrate 1 to which the functional fluid 54 has been applied is irradiated with UV light from the emission opening 48*a*, and the functional fluid 54 containing the curing agent is caused to solidify or cure.

Storage Part

Figure 5A:
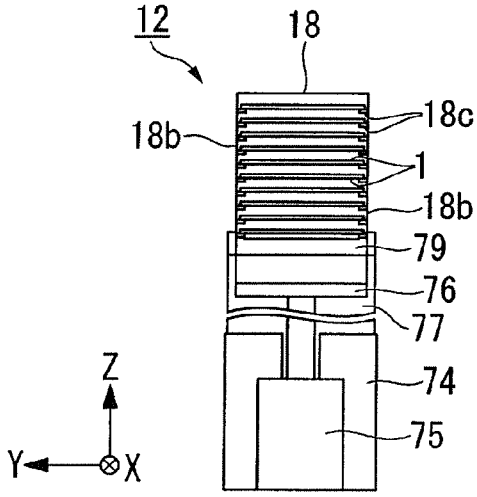
FIGS. 5A to 5C are schematic views showing a storage part.
Figure 5B:
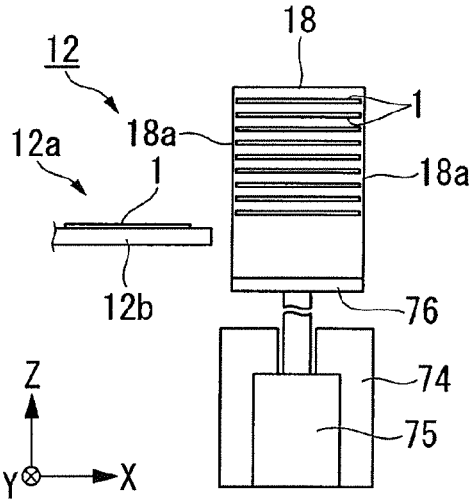
Figure 5C:
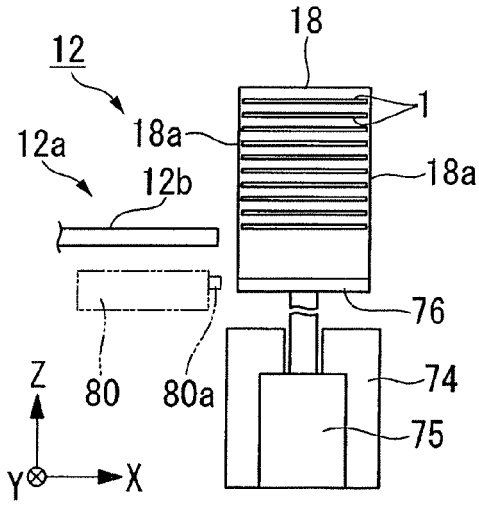

FIG. 5A is a schematic front view showing the storage part, and FIGS. 5B and 5C are schematic side views showing the storage part. As shown in FIGS. 5A and 5B, the storage part 12 comprises a base 74. A lift device 75 is installed in the base 74. A device similar to the lift device 16 installed in the feeding part 8 can be used for the lift device 75. A lift plate 76 is installed, in connection with the lift device 75, to an upper side of the base 74. The lift plate 76 is moved up and down by the lift device 75. A storage container 18 having a cuboid shape is installed on the lift plate 76, and semiconductor substrates 1 are stored in the storage container 18. For the storage container 18, a container identical to the storage container 18 installed in the feeding part 8 is used.

A semiconductor substrate 1 that has been placed by the transporting part 13 on the rails 12*b* functioning as a relay location is moved by the transporting part 13 from the rails 12*b* to the storage container 18. Alternatively, after the semiconductor substrate 1 has been moved by the transporting part 13 from the rails 12*b* partway toward the storage container 18, there may be provided, as shown, e.g., in FIG. 5C, a pushing device 80 positioned below the rails 12*b* and, in the y-direction, between each of the rails 12*b*, the pushing device 80 having a configuration similar to that of the pushing device 23 and capable of being raised by a lift device (not shown) to a position facing the semiconductor substrate 1 at the above-mentioned partway position. When the transporting part 13 is placing the semiconductor substrate 1 onto the rails 12*b*, the pushing device 80 is placed in standby status below the rails 12*b*, and when the transporting part 13 has withdrawn from the rails 12*b*, the pushing device 80 is raised so as to face a side surface of the semiconductor substrate 1, and the pushing pin 23*a* is caused to project towards the +x direction, whereby the semiconductor substrate 1 is moved into the storage container 18.

When the process described above, in which a semiconductor substrate 1 is stored in the storage container 18 and the storage container 18 is moved by the lift device 75 in the z-direction, has been performed repeatedly, and a predetermined number of semiconductor substrates 1 have been stored in the storage container 18, the operator subsequently replaces the storage container 18 in which the semiconductor substrates 1 are stored with an empty storage container 18. The operator can thereby carry a plurality of semiconductor substrates 1 together to a subsequent step.

Transporting Part

Figure 6B:
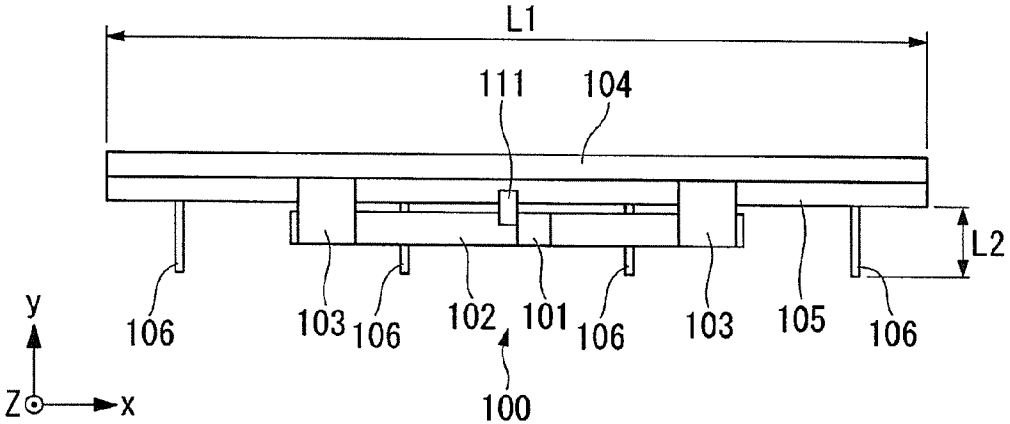
FIGS. 6A to 6C show the configuration of a transporting part.

Next, a description will be given for the transporting part 13 for transporting the semiconductor substrate 1 with reference to FIGS. 1, 6, and 7.

The transporting part 13 comprises a support body 83 provided to a ceiling part of the device. A rotary mechanism configured from a motor, an angle detector, a reducer, and other components is installed in the support body 83. An output shaft of the motor is connected to the reducer, and an output shaft of the reducer is connected to a first arm part 84 positioned on a lower side of the support body 83. The angle detector is installed in connection with the output shaft of the motor. The angle detector detects the angle of rotation about an axis parallel to the z-direction (third direction) of the output shaft of the motor. The rotary mechanism can thereby detect the angle of rotation of the first arm part 84, and cause the first arm part 84 to rotate to a desired angle.

A rotary mechanism 85 is installed on the first arm part 84, at an end opposite the support body 83. The rotary mechanism 85 is configured from a motor, an angle detector, a reducer, and other components; and is provided with a function similar to that of the rotary mechanism installed in the support body 83. The output shaft of the rotary mechanism 85 is connected to a second arm part 86. The rotary mechanism 85 can thereby detect the angle of rotation of the second arm part 86 and cause the second arm part 86 to rotate to a desired angle.

A lift device 87 and a rotary mechanism (driving part) 88 are positioned on the second arm part 86, at an end opposite the rotary mechanism 85. The lift device 87 comprises a linear motion mechanism. By driving the linear motion mechanism and thereby causing the lift device 87 to expand or contract in the z-direction, the gripping part 13*a* can be moved up or down in relation to the second arm part 86. A mechanism similar to, e.g., that of the lift device 16 of the feeding part 8 can be used for this linear motion mechanism. The rotary mechanism 88 has a similar configuration to that of the rotary mechanism 85, and causes the gripping part 13*a* to rotate about an axis 13*c* (see FIG. 6C) parallel to the z-direction in relation to the second arm part 86.

Figure 6A:
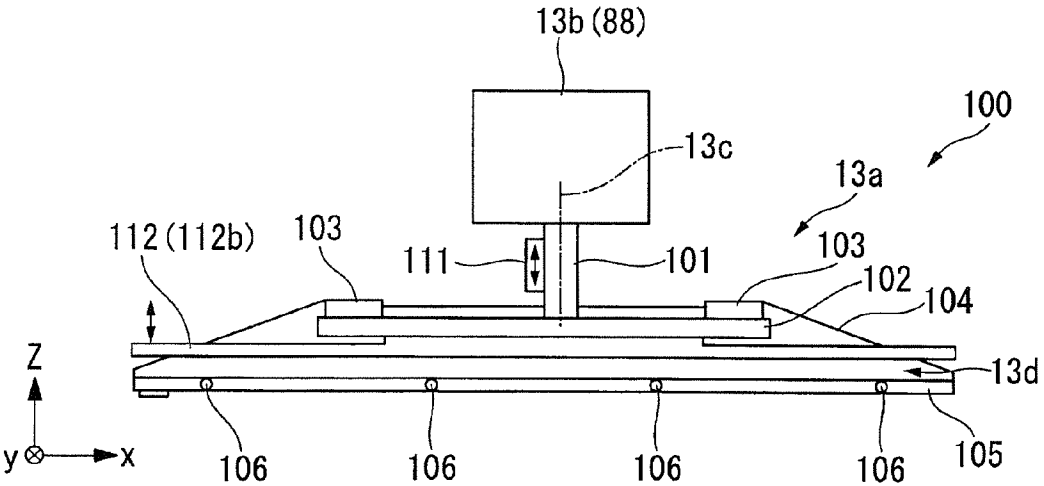
Figure 6C:
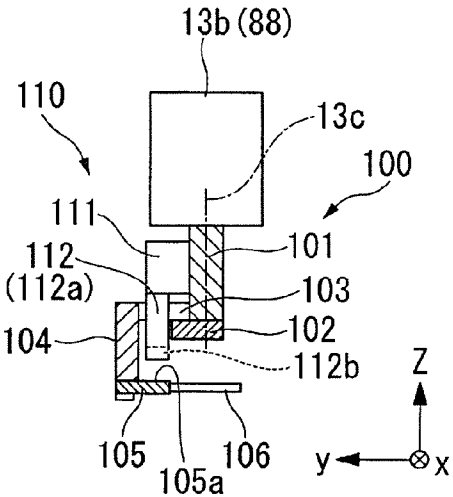

FIG. 6A is a front view showing the gripping part 13*a* provided to the −z side of the arm part 13*b*; FIG. 6B is a top view (in which the arm part 13*b* is not shown), and FIG. 6C is a left side view.

The gripping part 13*a* is provided so as to be capable of being rotatingly moved by the rotary mechanism 88 relative to the arm part 13*b* in a θz direction (a direction of rotation about the z-axis), and the position of the gripping part 13*a* in the x-y plane varies. Therefore, for the sake of convenience, in the following description, one direction parallel to the x-y plane is taken to be the x-direction, and a direction parallel to the x-y plane and orthogonal to the x-direction is taken to be the y-direction (the z-direction is unchanged).

The gripping part 13*a* comprises a fixed part 100 that is capable of rotating in the θz direction relative to the arm part 13*b* and that is used in a fixed state when the semiconductor substrate 1 is gripped; and a moving part 110 provided so as to be capable of moving in the z-direction relative to the fixed part 100.

The fixed part 100 is configured primarily from a z-axis member 101, a bridge member 102, connecting members 103, a connecting plate 104, a holding plate (first gripping part) 105, and fork parts (support parts) 106. The z-axis member 101 extends in the z-direction, and is provided to the arm part 13*b* so as to be capable of rotating about the z-axis. The bridge member 102 is formed as a plate shape extending in the x-direction, and secured at a center part in the x-direction to a lower end of the z-axis member 101. The connecting plate 104 is positioned parallel to the bridge member 102 so that a gap is present therebetween, and is connected to the bridge member 102, at both end sides thereof in the x-direction, by the connecting members 103. The holding plate 105 is formed as a plate shape extending in the x-direction, and, as shown in FIG. 6C, is secured along an end edge on the +y side on a surface on the +z side to a lower end of the connecting plate 104. Of the surface of the holding plate 105 on the +z side, an end edge on the −y side represents a holding surface 105*a* used when the semiconductor substrate 1 is held.

The fork parts 106 are used to support, from below, a lower surface (a surface on the −z side) of the semiconductor substrate 1 held by the holding surface 105*a*. A plurality (4 in this instance) of the fork parts 106 are provided, at intervals along the x-direction, so as to extend in the y-direction from a side surface of the holding plate 105 on the −y side. The number of fork parts 106 and the interval at which the fork parts 106 are positioned are set so that even in an instance in which the length of the semiconductor substrate 1 fluctuates according to the model or another criteria, the semiconductor substrate 1 can be supported at at least one place, and preferably in two or more places, along a length direction.

The moving part 110 is configured primarily from a lift part 111 and a gripping plate (second gripping part) 112. The lift part 111 is configured from an air cylinder mechanism or a similar mechanism, and travels up/down along the z-axis member 101. The gripping plate 112 is integrally formed using an inserting part 112*a* and a holding plate 112*b*. The inserting part 112*a* is provided so as to be capable of rising and descending integrally with the lift part 111. The inserting part 112*a* is shorter than the length, in the x-direction, of a spacing between the connecting members 103, 103, and is smaller in width than the spacing between the bridge member 102 and the connecting plate 104. The inserting part 112*a* is inserted, so as to be capable of moving in the z-direction, in the spacing between the connecting members 103, 103 and the spacing between the bridge member 102 and the connecting plate 104. The holding plate 112*b* is positioned further below the inserting part 112*a*, and extends, further below the bridge member 102, in the x-direction by a length that is substantially the same as that of the holding plate 105.

The gripping plate 112 comprising the inserting part 112*a* and the holding plate 112*b* moves integrally in the z-direction in accordance with the movement of the lift part 111 in the vertical direction. When the gripping plate 112 descends, one end edge of the semiconductor substrate 1 can be held and gripped between the gripping plate 112 and the holding plate 105. When the gripping plate 112 rises, the gripping plate 112 moves away from the holding plate 105, whereby the grip on the semiconductor substrate 1 is released.

The holding plate 105 and the gripping plate 112, capable of gripping the semiconductor substrate 1, form in a gap therebetween a gripping region 13*d* extending continuously in the x-direction along the length of the holding plate 105 and the gripping plate 112. As shown in FIG. 6B, the length L1 of the holding plate 105, the gripping plate 112, and the gripping region 13*d* is formed so as to be longer than the length L2 of the fork parts 106.

In the present embodiment, a rotation center axis (axis) 13*c* in relation to the rotation of the gripping part 13*a* by the rotary mechanism 88 is set so as to be positioned, in relation to the y-direction, which is the length direction of the fork parts 106, in a region in which the fork parts 106 are positioned, as shown in FIG. 6C. In relation to the x-direction, which is the length direction of the holding plate 105 and the gripping plate 112, the rotation center axis 13*c* is positioned at substantially a center of the gripping region 13*d*.

When the semiconductor substrate 1 is transported by the transporting part 13, the fork parts 106 support the semiconductor substrate 1 from below. Therefore, as shown in FIG. 7, groove sections 141 are provided, at each position corresponding to each of the fork parts 106 during transportation, to the first and second relay locations 9*a*, 9*b* of the pretreatment part 9, the treatment locations 11*a*, 11*b* of the cooling part 11, and the first and second relay locations 14*a*, 14*b* of the post-treatment part 14 (hereafter collectively referred to as placing parts 140), the transported semiconductor substrate 1 being placed on a surface of a placing part 140. A plurality of suction parts 142, for suctioning and retaining the semiconductor substrate 1 placed on the placing part 140, are disposed near the groove sections 141 on the placing part 140.

Then, an output from the detector positioned on the transporting part 13 is inputted, the position and the orientation of the gripping part 13*a* are detected, the rotary mechanism 85 and other components are driven, and the gripping part 13*a* is moved to a predetermined position, whereby it is possible to transport the semiconductor substrate 1 gripped by the gripping part 13*a* to a predetermined treatment part.

Figure 8:
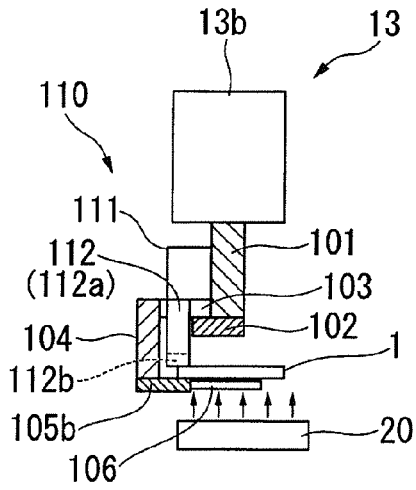
FIG. 8 is a front view showing a positional relationship between the transporting part and the static eliminator.
Figure 9:
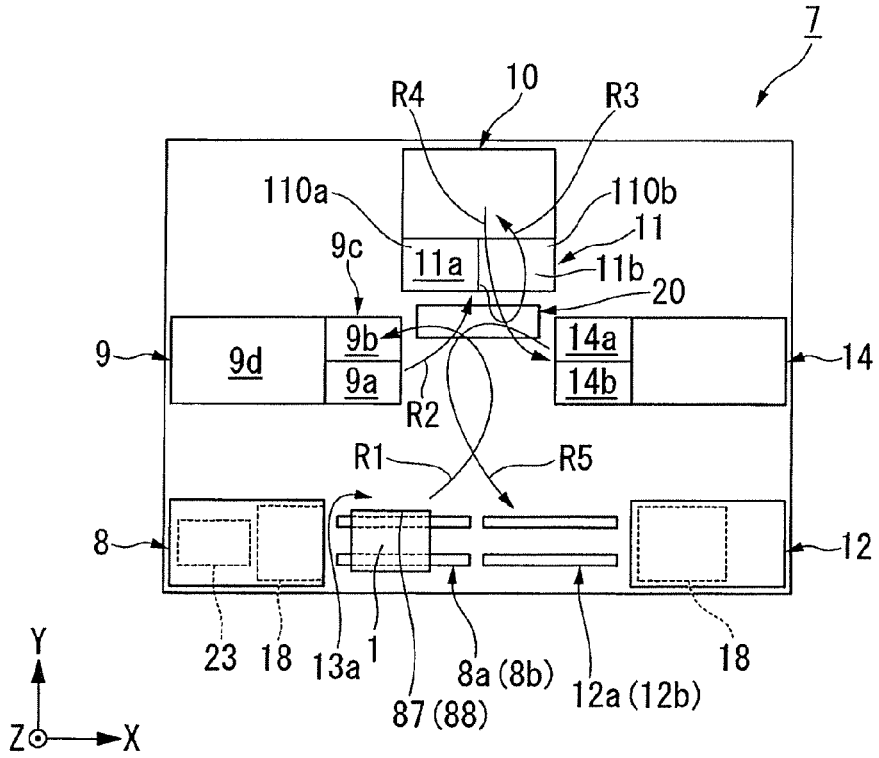
FIG. 9 is a view showing a path along which the semiconductor substrate 1 is transported.

As shown in FIG. 8, the static eliminator 20 is installed below a path along which the semiconductor substrate 1 is transported by the transporting part 13 so that a gap is present with respect to the transport path. The static eliminator 20 feeds ionized air onto a lower surface (surface on the −z side) of the semiconductor substrate 1, whereby static electricity that has built up in the semiconductor substrate 1 is neutralized and eliminated. As described further below, the transporting part 13, when transporting the semiconductor substrate 1 to each of the treatment devices, transports the semiconductor substrate 1 so that the semiconductor substrate 1 follows a transport path that is invariably routed above the static eliminator 20, as shown in FIG. 9. It is preferable that the scalar-type robot, which is the transporting part 13, is in a state of being suspended from the support body 83 provided to the ceiling part in the device, and that the static eliminator 20 is provided below the scalar-type robot and a range of possible movement thereof, as shown in FIG. 1B and FIG. 6C. A configuration of such description makes it possible to position each of the treatment parts and the static eliminator 20 without interfering with the operation of the scalar-type robot.

FIG. 10 is a block diagram of a control system of the printing device 7.

As shown in FIG. 10, the operation of each of the feeding part 8, the pretreatment part 9, the application part 10, the post-treatment part 14, the storage part 12, and the transporting part 13 is controlled overall by the controller CONT.

Printing Method

A description will now be given for a printing method in which the printing device 7 is used, with reference to FIG. 11.

Figure 11:
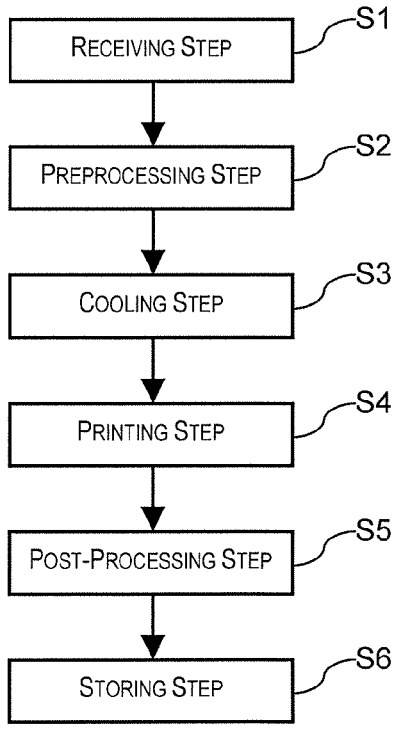
FIG. 11 is a flow chart showing a printing method.

FIG. 11 is a flow chart showing the printing method. As shown in FIG. 11, the printing method is primarily configured from: a receiving step S1 for receiving the semiconductor substrate 1 from the storage container 18; a pretreatment step S2 for performing pretreatment on the surface of the received semiconductor substrate 1; a cooling step S3 for cooling the semiconductor substrate 1 whose temperature has risen during the pretreatment step S2; a printing step S4 for drawing and printing a variety of marks on the cooled semiconductor substrate 1; a post-treatment step S5 for performing post-treatment on the semiconductor substrate 1 on which a variety of marks have been printed; and a storage step S6 for storing, in the storage container 18, the semiconductor substrate 1 on which post-treatment has been performed.

Figure 7A:
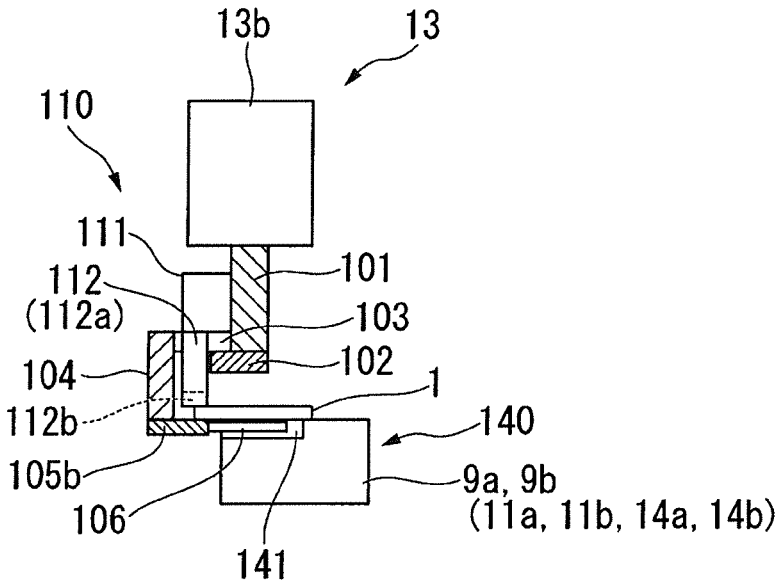
FIGS. 7A and 7B show the configuration of the transporting part, the placing part and the substrate.
Figure 7B:
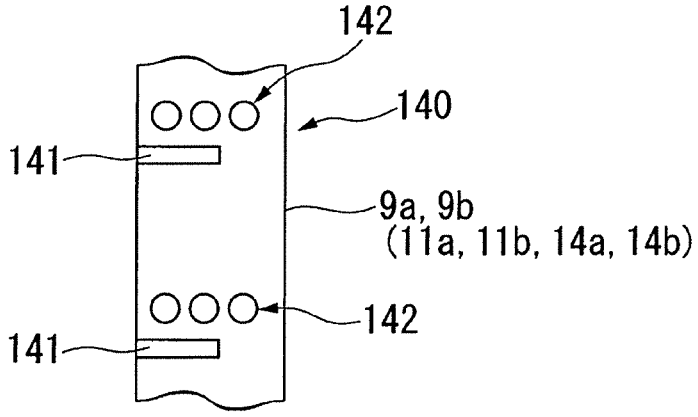

When the semiconductor substrate 1 is treated in each of the above-mentioned steps, first, the fork parts 106 support the semiconductor substrate 1 from below while the gripping part 13*a* of the transporting part 13 holds one side edge of the semiconductor substrate 1, whereby the semiconductor substrate 1 is gripped. Specifically, in a state in which the lift part 111 has brought the gripping plate 112 away from the holding plate 105 as shown in FIG. 6C, the gripping part 13*a* is moved toward a position of such height that the semiconductor substrate 1 can be placed on the holding plate 105 and the fork parts 106, and toward a position at which the fork parts 106 can enter the groove sections 141 as shown in FIG. 7A; then, the gripping part 13*a* is moved towards the placing part 140, and the holding plate 105 and the fork parts 106 are caused to support the semiconductor substrate 1 thereon. The lift part 111 subsequently causes the gripping plate 112 to descend, and hold and grip the side edge of the semiconductor substrate 1 with respect to the holding plate 105.

The lift device 87 then moves the gripping part 13*a* to a predetermined height, whereby the semiconductor substrate 1 is peeled from the placing part 140 and transported to a treatment device at which a treatment for the next step is to be performed. At this point, static electricity builds up primarily on the reverse surface (surface on the −z side) of the semiconductor substrate 1 due to peeling electrification. Therefore, the controller CONT causes the transporting part 13 to follow a transport path routed via the static eliminator 20, as a path along which the semiconductor substrate 1 is transported to a treatment device corresponding to the next step.

Specifically, as shown in FIG. 9, in an instance in which, e.g., the semiconductor substrate 1 is transported from the relay location 8*a* of the feeding part 8 to the relay location 9*c* of the pretreatment part 9, the transporting is performed along a transport path R1 routed via the static eliminator 20. Similarly, to transport the semiconductor substrate 1 from the pretreatment part 9 to the cooling part 11, the transporting is performed along a transport path R2; to transport the semiconductor substrate 1 from the cooling part 11 to the application part 10, the transporting is performed along a transport path R3; to transport the semiconductor substrate 1 from the application part 10 to the post-treatment part 14, the transporting is performed along a transport path R4; and to transport the semiconductor substrate 1 from the post-treatment part 14 to the storage part 12, the transporting is performed along a transport path R5. In all instances, the transporting is performed via the static eliminator 20.

In each of the transport paths R1 through R5, when the semiconductor substrate 1 reaches the static eliminator 20, the transporting speed is temporarily reduced or brought to zero. Then, as shown in FIG. 8, ionized air is fed from the static eliminator 20 to a reverse-surface side of the semiconductor substrate 1, whereby static electricity that had built up is neutralized and eliminated. At this point, the semiconductor substrate 1 is in a state in which the speed of movement for transportation has been reduced or brought to zero. Therefore, the total amount of ionized air fed to the semiconductor substrate 1 is larger, and the static elimination treatment performed by the static eliminator 20 is performed in an effective manner. Also, since the static elimination treatment is performed on the reverse-surface side at which the static buildup on the semiconductor substrate 1 primarily occurs, the static elimination treatment is performed in an even more effective manner.

After the static elimination treatment has been performed on the semiconductor substrate 1, when the transporting part 13 transports the semiconductor substrate 1 to a position facing a placing part 140 at which a treatment corresponding to the next step is to be performed, the lift device 87 drives the gripping part 13*a* so as to descend, and the transporting part 13 hands over the semiconductor substrate 1 onto a surface of the placing part 140 as shown in FIG. 7A. Since the groove sections 141 are formed on the placing part 140 so that the positions and size correspond to the fork parts 106, the fork parts 106 enter the groove sections 141 when the semiconductor substrate 1 is handed over, and interference with respect to the placing part 140 is avoided. Also, since the semiconductor substrate 1 has been subjected to static elimination in advance, no electrical discharge will occur and adversely affect the semiconductor device 3, even in an instance in which the placing part 140 is electrically conductive.

The semiconductor substrate 1, having been handed over onto the surface of the placing part 140, is subjected to a predetermined treatment (e.g., cooling treatment) in a state of being suctioned and retained against the surface of the placing part 140 by the suction parts 142, or transported onto a stage on which the application treatment or the pretreatment is to be performed.

The semiconductor substrate 1, having been transported by the transporting part 13, is subjected in the pretreatment step S2 to a pretreatment (surface-reforming treatment in a heated state) of the semiconductor substrate 1, cooled in the cooling step S3, and subjected in the printing step S4 to a treatment of printing a variety of marks on the semiconductor device 3. The semiconductor substrate 1, having been subjected to the treatment of printing a variety of marks, is subjected to post-treatment in the post-treatment step S5, then in the storing step S6 stored in the storage container 18, and discharged via the storage container 18.

As described above, in the present embodiment, the static eliminator 20 is provided so as to be near the transport path of the transporting part 13, and the semiconductor substrate 1 is transported along a transport path routed via the static eliminator 20. Therefore, it is possible to subject the semiconductor substrate 1 to static elimination without providing a large number of static eliminators or generating a need to provide a space through which a static eliminator can move, and it is possible to avoid making the device larger or more expensive in order for static elimination to be performed.

In the present embodiment, the speed of transporting of the semiconductor substrate 1 with regards to the static eliminator 20 is reduced, and it is therefore possible to perform the static elimination treatment on the semiconductor substrate 1 in a more effective manner. Also, in the present embodiment, the static eliminator 20 is provided below the path along which the semiconductor substrate 1 is transported. Therefore, it becomes possible to perform static elimination in a manner that concentrates on the reverse surface (lower surface) of the semiconductor substrate 1 where peeling electrification readily occurs, and the static elimination treatment can be performed in an effective manner. In addition, in the present embodiment, the gripping part 13*a* of the transporting part 13 grips the side edge of the semiconductor substrate 1. Therefore, the lower surface of the semiconductor substrate 1 can be subjected to static elimination in a substantially complete manner, and the static elimination treatment can be performed in an even more effective manner.

While a preferred embodiment of the present invention has been described above with reference to drawings, it shall be apparent that the present invention is not limited by the example. The shape, combination, and other attributes of each of the constituent members shown in the example described above are only one example, and can be modified in a variety of ways on the basis of design requirements and other factors without departing from the main points of the present invention.

For example, the position of the static eliminator 20 with respect to the top view shown in the above-mentioned embodiment is only an example; any position is possible as long as transporting by the transporting part 13 to the position is possible. However, it is preferable that, e.g., a simulation of the total length of the transport path is performed in relation to positions at which the static eliminator 20 can be installed, and the static eliminator 20 is provided at the position at which the transport path is the shortest.

In the above-mentioned embodiment, the static eliminator 20 is provided at a position surrounded by the application part 10, the pretreatment part 9, the cooling part 11, the post-treatment part 14, the feeding part 8, and the storage part 12. However, the static eliminator 20 is preferably positioned on the path along which the transporting part 13 transports the semiconductor substrate 1 without being limited to the layout described above. The static eliminator 20 may be positioned at a position sandwiched by at least two of the treatment parts, or may be positioned at a position near at least two treatment parts.

Also, in the above-mentioned embodiment, a description was given for an example of a configuration in which the static eliminator 20 is provided below the path along which the semiconductor substrate 1 is transported; however, this is not provided by way of limitation. In an instance such as when there is a restriction in terms of space, a configuration in which the static eliminator 20 is provided above the transport path is also possible. In such an instance, a configuration is possible in which, e.g., the static eliminator 20 is configured to emit soft X-rays; a thin mirror member for reflecting the soft X-rays emitted from the static eliminator 20 towards the lower surface of the semiconductor substrate 1 is provided, e.g., below the transport path; and the soft X-rays are emitted via the mirror member onto the lower surface of the semiconductor substrate 1; whereby air near the bottom surface is ionized and static elimination is performed.

With regards to the holding plate 105 and the gripping plate 112 of the transporting part 13, at least one may be formed from a grounded electroconductive material.

In such an instance, the adverse effect of static electricity on the semiconductor substrate 1 can be eliminated in a more efficient manner, and the semiconductor device 3 and other components can prevented from being damaged by static electricity. With regards to the holding plate 105 and the gripping plate 112, at least one may be configured from a metal, configured from an electroconductive rubber, or have an electroconductive film formed on a surface. Electroconductivity treatment may also be applied using a predetermined material.

In the above-mentioned embodiment, UV-curing ink is used as UV ink. However, this is not provided by way of limitation to the present invention; a variety of active-light-curing inks, for which visible light rays or IR rays can be used as curing light, can also be used.

Similarly, for the light source, a variety of types of sources of active light for generating visible light or other active light, i.e., active light emission parts, can be used.

In the present invention, no specific restrictions exist for the active light as long as irradiation of the active light can provide energy capable of generating initiating species in the ink. The term "active light" broadly encompasses α-rays, γ-rays, X-rays, UV rays, visible light, electron beams, and other radiation. In particular, UV rays and electron beams are preferred from the viewpoint of curing sensitivity and ease of obtaining a device; and UV rays are particularly preferred. Therefore, it is preferred that a UV-curing ink, which can be cured by being subjected to UV irradiation, is used as the active-light-curing ink such as with the present embodiment.

Also, in the above-mentioned embodiment, the printing device has, as treatment parts, the application part 10, the pretreatment part 9, the cooling part 11, the post-treatment part 14, the feeding part 8, and the storage part 12. However, the printing device may merely have at least two of the above-listed treatment parts. In the above-mentioned embodiment, the printing device has the application part 10; however, this is not provided by way of limitation; the application part 10 may instead be an inspecting part for inspecting the semiconductor device, a film-forming device for forming a predetermined film, or an etching device for performing etching of a predetermined film.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A marking device comprising:

a plurality of treatment devices with each of the treatment devices being configured and arranged to perform a treatment on a base material;

a transporting part configured and arranged to transport the base material between the treatment devices;

a static eliminator disposed near a path along which the base material is transported by the transporting part; and a controller configured to control the transporting part to follow a transport path routed via the static eliminator when the base material is transported to the treatment devices, the controller being configured to reduce a speed at which the base material is transported at the static eliminator to be lower than a speed at which the base material is transported to the static eliminator.

2. The marking device according to claim 1, wherein the transporting part includes a scalar-type robot.

3. The marking device according to claim 1, wherein the static eliminator is configured to perform a static elimination treatment on a side of the base material at which the base material is retained by the treatment devices.

4. The marking device according to claim 1, wherein the transporting part includes a gripping part configured and arranged to grip, in a cantilevered fashion, an end edge of the base material.

5. The marking device according to claim 1, wherein the treatment devices include an application device configured and arranged to apply liquid droplets on a semiconductor device provided to a surface of the base material.

6. The marking device according to claim 5, wherein the application device is configured and arranged to eject, onto the base material that has been transported by the transporting part, the liquid droplets of a liquid that is curable by active light.

7. A manufacturing device comprising:

a plurality of treatment devices;

a transporting part configured and arranged to transport a base material between the treatment devices;

a static eliminator disposed near a path along which the base material is transported by the transporting part; and a controller configured to control the transporting part to follow a transporting part routed via the static eliminator when the base material is transported to the treatment devices, the controller being configured to reduce a speed at which the base material is transported at the static eliminator to be lower than a speed at which the base material is transported to the static eliminator.

8. The manufacturing device according to claim 7, wherein the transporting part includes a scalar-type robot.

9. A marking method comprising:

providing a plurality of treatment devices, each of which devices is configured and arranged to perform a treatment on a base material;

transporting the base material between the treatment devices; and providing a static eliminator near a path along which the base material is transported, the transporting of the base material including transporting the base material so that the base material follows a transporting path routed via the static eliminator when the base material is transported to the treatment devices, and reducing a speed at which the base material is transported at the static eliminator to be lower than a speed at which the base material is transported to the static eliminator.

* * * * *